US010344980B2

(12) United States Patent
Park et al.

(10) Patent No.: US 10,344,980 B2
(45) Date of Patent: Jul. 9, 2019

(54) COMBUSTOR ASSEMBLY WITH A DEFLECTOR IN BETWEEN SWIRLERS ON THE BASE PORTION

(71) Applicant: HANWHA AEROSPACE CO., LTD., Changwon-si (KR)

(72) Inventors: Hee Ho Park, Changwon-si (KR); Su Hyeong Cho, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 0 days.

(21) Appl. No.: 15/323,590

(22) PCT Filed: Oct. 27, 2014

(86) PCT No.: PCT/KR2014/010115

§ 371 (c)(1),
(2) Date: Feb. 2, 2017

(87) PCT Pub. No.: WO2016/003020

PCT Pub. Date: Jan. 7, 2016

(65) Prior Publication Data

US 2017/0234538 A1 Aug. 17, 2017

(30) Foreign Application Priority Data

Jul. 3, 2014 (KR) ..... 10-2014-0083231

(51) Int. Cl.
*F23R 3/04* (2006.01)
*F23R 3/14* (2006.01)
(Continued)

(52) U.S. Cl.
CPC ..... *F23R 3/14* (2013.01); *F23R 3/002* (2013.01); *F23R 3/04* (2013.01); *F23R 3/42* (2013.01);
(Continued)

(58) Field of Classification Search
CPC ..... F23R 3/14; F23R 3/04; F23R 3/08; F23R 3/26; F23R 3/002; F23R 3/42;
(Continued)

(56) References Cited

U.S. PATENT DOCUMENTS 4,085,580 A * 4/1978 Slattery ..... F23R 3/002 60/756
4,480,436 A * 11/1984 Maclin ..... F23R 3/002 60/752
(Continued)

FOREIGN PATENT DOCUMENTS

JP 2004-226051 A 8/2004
JP 2005-180730 A 7/2005
JP 2010-281483 A 12/2010

OTHER PUBLICATIONS

Search Report dated Mar. 24, 2015 issued by the International Searching Authority in counterpart International Application No. PCT/KR2014/010115 (PCT/ISA/210).
(Continued)

*Primary Examiner* — William H Rodriguez
*Assistant Examiner* — James P McGlynn
(74) *Attorney, Agent, or Firm* — Ladas & Parry LLP

(57) ABSTRACT

Provided is a combustor assembly. The combust assembly includes: a plurality of swirlers through which a first fluid that is a part of a fluid discharged from a compressor passes; a base portion, in which the plurality of swirlers are provided, comprising a first through hole formed between one swirler and another swirler from among the plurality of swirlers so that a second fluid that is another part of the fluid discharged from the compressor and different from the first fluid passes through the first through hole; and a deflector provided in the base portion so as to face the first through hole for changing a moving direction of the second fluid.

7 Claims, 5 Drawing Sheets

(51) Int. Cl.
*F23R 3/42* (2006.01)
*F23R 3/00* (2006.01)
*F23R 3/28* (2006.01)

(52) U.S. Cl.
CPC .... *F05D 2240/15* (2013.01); *F05D 2260/201* (2013.01); *F05D 2260/202* (2013.01); *F05D 2260/203* (2013.01); *F23R 3/286* (2013.01); *F23R 2900/03041* (2013.01); *F23R 2900/03042* (2013.01); *F23R 2900/03044* (2013.01)

(58) Field of Classification Search
CPC .. F23R 2900/03041; F23R 2900/03042; F23R 2900/03044; F23R 3/286; F05D 2240/15; F05D 2260/201; F05D 2260/202; F05D 2260/203
See application file for complete search history.

(56) References Cited

U.S. PATENT DOCUMENTS 5,220,795 A * 6/1993 Dodds ..... F23R 3/04 60/747
5,253,471 A * 10/1993 Richardson ..... F23R 3/10 60/754
5,321,951 A * 6/1994 Falls ..... F23R 3/34 60/740
5,528,896 A * 6/1996 Alary ..... F23R 3/12 60/747
5,592,819 A 1/1997 Ansart et al.
5,746,048 A 5/1998 Shah
5,966,937 A * 10/1999 Graves ..... F23C 7/004 239/400
5,987,889 A * 11/1999 Graves ..... F23C 7/004 60/746
8,555,646 B2 10/2013 Stevenson et al.
2010/0011775 A1* 1/2010 Garry ..... C23C 4/02 60/752
2011/0088402 A1 4/2011 Commaret et al.
2013/0192233 A1* 8/2013 Eastwood ..... F23R 3/002 60/752
2013/0192262 A1 8/2013 Eastwood et al.

OTHER PUBLICATIONS

Written Opinion dated Mar. 24, 2015 issued by the International Searching Authority in counterpart International Application No. PCT/KR2014/010115 (PCT/ISA/237).

* cited by examiner

[Fig. 1]
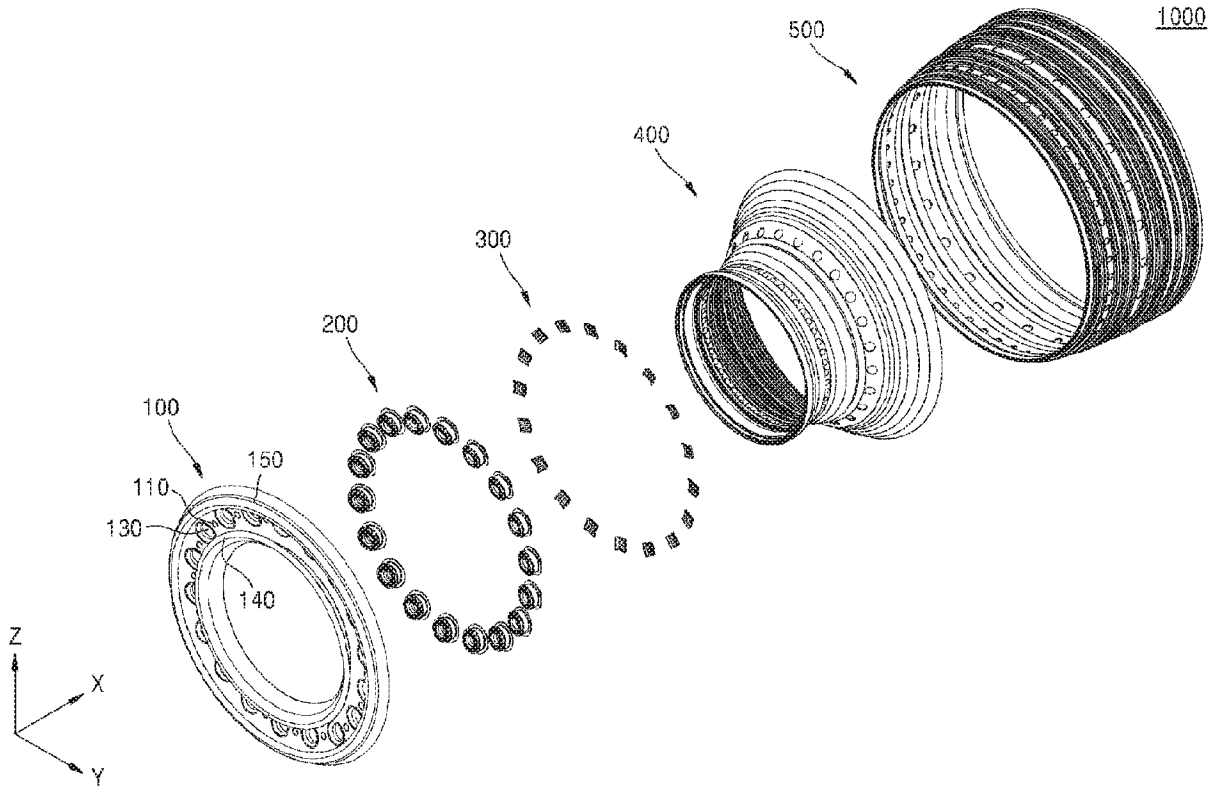

[Fig. 2]
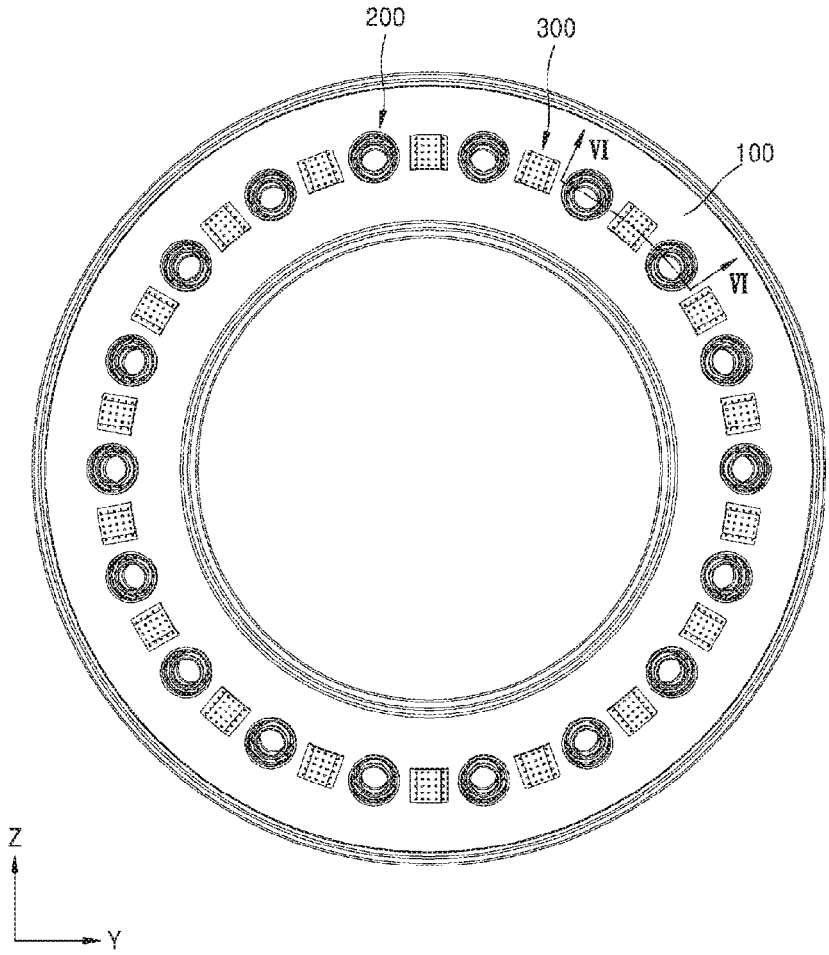

[Fig. 3]
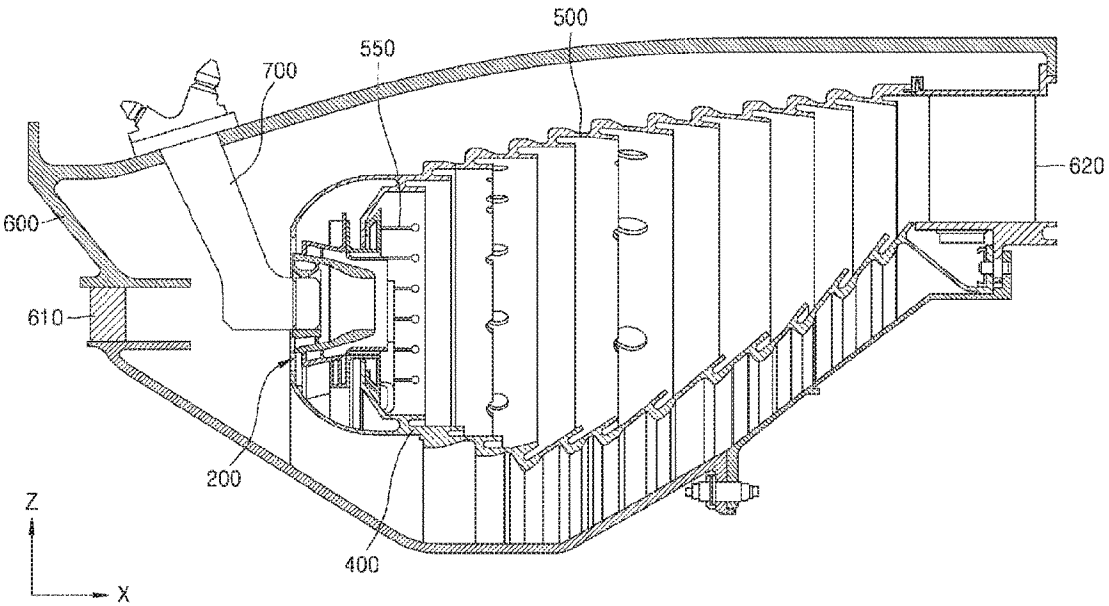
[Fig. 4a]
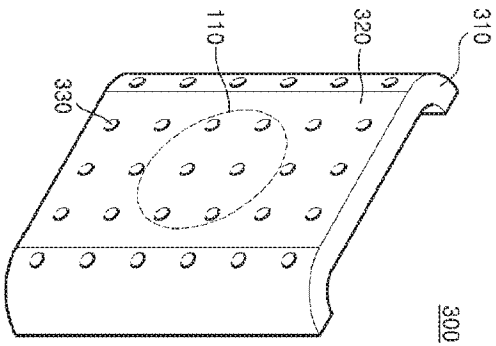

[Fig. 4b]
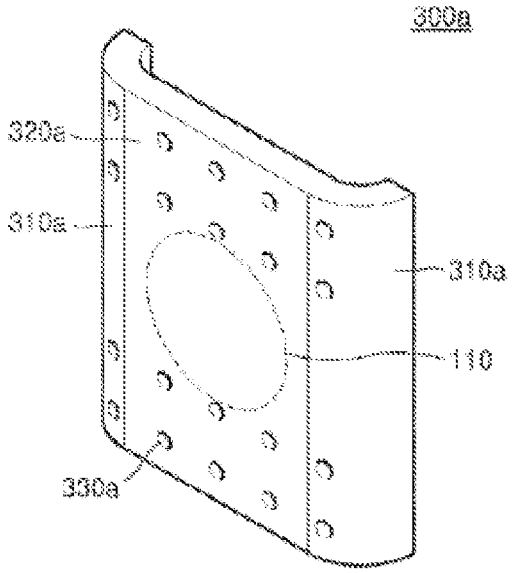
[Fig. 5]
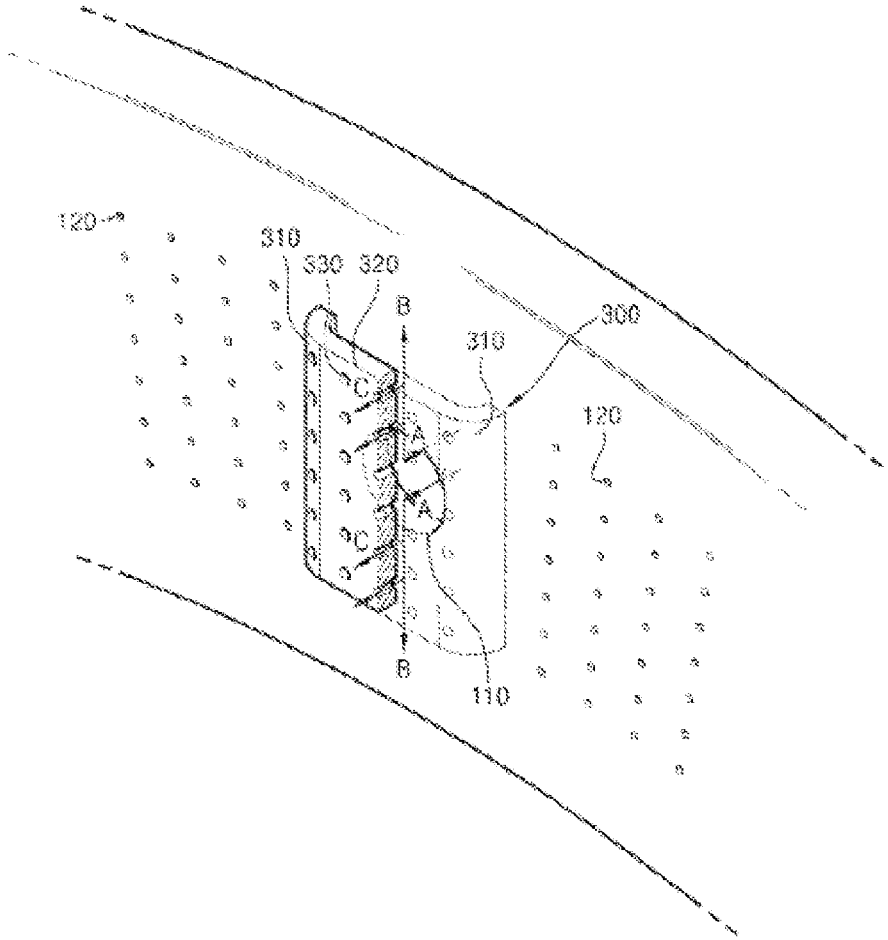

[Fig. 6]
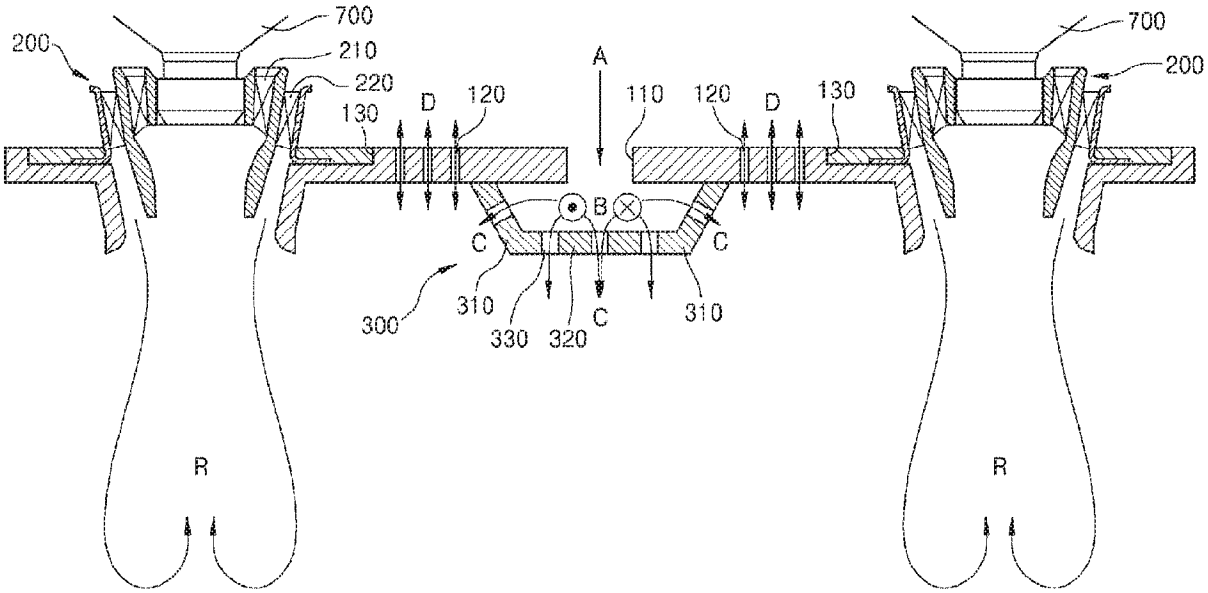

COMBUSTOR ASSEMBLY WITH A DEFLECTOR IN BETWEEN SWIRLERS ON THE BASE PORTION

TECHNICAL FIELD

The present invention relates to a combustor assembly.

BACKGROUND ART

A gas turbine is a heat engine that drives a turbine by using a combustion gas of high temperature and high pressure, and generally includes a compressor, a combustor, and a turbine. The compressor compresses air, the combustor burns the air by injecting fuel, and then, the air of high temperature and high pressure expands in the turbine to generate a driving power.

A region, where flames are not swept but fixed at an appropriate position, in the combustor is referred to as a central recirculation zone (CRZ). In order to maintain the combustion continuously and to prompt mixture of the fuel and an oxidizing agent in the combustor, it is important to maintain an appropriate CRZ according to flow. That is, in order to maintain the CRZ, a swirl component has to be applied to the flow.

DETAILED DESCRIPTION OF THE INVENTIVE CONCEPT

Technical Problem

During combustion, a flow of high temperature is generated in a combustor. Therefore, it is important to cool down the combustor appropriately for maintaining durability of the combustor. In general, some of air discharged from a compressor is used to cool down the combustor. The air discharged from the compressor has a temperature that is relatively lower than that of combusted air, and thus, the air is diverged from the compressor and the diverged air is used as a cooling fluid.

A method of cooling down a combustor as described above is disclosed in Japanese Laid-open Patent Publication No. 2009-079484 (Title of the Invention: Gas Turbine Combustor).

Technical Solution

One or more embodiments of the present invention include a combustor assembly capable of improving a cooling effect.

According to an embodiment of the present invention, there is provided a combustor assembly including: a plurality of swirlers through which a first fluid that is a part of a fluid discharged from a compressor passes; a base portion, in which the plurality of swirlers are provided, including a first through hole formed between one swirler and another swirler from among the plurality of swirlers so that a second fluid that is another part of the fluid discharged from the compressor and different from the first fluid passes through the first through hole; and a deflector provided in the base portion so as to face the first through hole, thereby changing a moving direction of the second fluid.

Advantageous Effects

According to embodiments of the present invention, a combustor assembly may be effectively cooled down by using a deflector while maintaining a flow stability in the combustor assembly.

However, the scope of the invention is not limited to the above effects.

DESCRIPTION OF THE DRAWINGS

FIG. 1 is an exploded perspective view of a combustor assembly according to an embodiment;

FIG. 2 is a rear view showing some elements of the combustor assembly of FIG. 1;

FIG. 3 is a cross-sectional view of the combustor assembly of FIG. 1;

FIG. 4A is a perspective view of a deflector of FIG. 1;

FIG. 4B is a perspective view of a deflector according to another embodiment of the present invention;

FIG. 5 is a perspective view showing an enlarged view of the deflector of FIG. 1; and FIG. 6 is a cross-sectional view taken along a line VI-VI of FIG. 2.

BEST MODE

According to an aspect of the present invention, a combustor assembly includes: a plurality of swirlers through which a first fluid that is a part of a fluid discharged from a compressor passes; a base portion, in which the plurality of swirlers are provided, including a first through hole formed between one swirler and another swirler from among the plurality of swirlers so that a second fluid that is another part of the fluid discharged from the compressor and different from the first fluid passes through the first through hole; and a deflector provided in the base portion so as to face the first through hole, thereby changing a moving direction of the second fluid.

The base portion may include a second through hole adjacent to the first through hole.

A diameter of the first through hole may be greater than a diameter of the second through hole.

Centers of the plurality of swirlers and a center of the first through hole may be spaced apart a predetermined distance from a center of the base portion.

The deflector may change the moving direction of the second fluid from a lengthwise direction of the combustor assembly to a radial direction of the combustor assembly.

The deflector may be formed so as to be at least partially curved.

The deflector may include a supporter supported by the base portion and a direction switching portion extending from the supporter, and the fluid that has passed through the first through hole may be moved between the direction switching portion and the base portion.

The deflector may include a through hole, through which the second fluid passes.

The through hole may be formed at an outer portion of the deflector.

According to an aspect of the present invention, a combustor assembly includes: a plurality of swirlers through which a fluid discharged from a compressor passes; a base portion in which the plurality of swirlers are formed; and a liner extending towards the base portion to guide the fluid that has passed through the plurality of swirlers, wherein the liner includes an anti-deformation portion that expands or contracts according to a thermal transfer from the fluid.

MODE OF THE INVENTION

The present invention will now be described more fully with reference to the accompanying drawings, in which exemplary embodiments of the invention are shown. The present invention may, however, be embodied in many different forms and should not be construed as being limited to the exemplary embodiments set forth herein; rather, these embodiments are provided so that this disclosure will be thorough and complete, and will fully convey the concept of the inventive concept to those skilled in the art. The scope of the present invention is defined by the following claims. The terms used in the present specification are merely used to describe particular embodiments, and are not intended to limit the present invention. An expression used in the singular encompasses the expression in the plural, unless it has a clearly different meaning in the context. It will be further understood that the terms "comprises" and/or "comprising" used herein are not intended to preclude the possibility that one or more other features, steps, actions, and/or parts thereof may exist or may be added. It will be understood that although the terms "first" and "second" are used herein to describe various elements, these elements should not be limited by these terms. Terms are only used to distinguish one element from other elements.

FIG. 1 is an exploded perspective view of a combustor assembly 1000 according to an embodiment of the present invention, FIG. 2 is a rear view showing some elements of the combustor assembly 1000 of FIG. 1, and FIG. 3 is a cross-sectional view of the combustor assembly 1000 of FIG. 1.

Referring to FIGS. 1 to 3, the combustor assembly 1000 may include a base portion 100, a swirler 200, a deflector 300, a first liner 400, a second liner 500, a housing 600, and a fuel injection portion 700.

The combustor assembly 1000 is connected to a compressor (not shown) so that a compressed fluid may be introduced therein from the compressor via an inlet 610 of the housing 600. A first fluid, that is, a part of the fluid discharged from the compressor, is introduced into the swirler 200, and then, reacts with fuel to be combusted in an internal space of the combustor assembly 1000. A second fluid, that is, a part of the fluid discharged from the compressor and different from the first fluid, moves along a first through hole 110 formed in the base portion 100 in order to effectively cool down the combustor assembly 1000. A third fluid, that is, another fluid discharged from the compressor, is moved to a space between the housing 600 and the first liner 400 or a space between the housing 600 and the second liner 500, and then, may be discharged through an outlet 620 of the housing 600.

The base portion 100 is coupled to the swirler 200 and the deflector 300 so that the fluid discharged from the compressor may be introduced into the combustor assembly 1000. The base portion 100 may include the first through hole 110, a second through hole 120 (see FIG. 5), an insertion hole 130, a first rib 140, and a second rib 150.

There may be provided a plurality of the first through holes 110, and the plurality of first through holes may be arranged radially based on a center of the base portion 100. Centers of the first through holes 110 may be spaced apart a predetermined distance from the center of the base portion 100. The second fluid may be introduced into the internal space of the combustor assembly 1000 after passing through the first through hole 110.

The second through hole 120 is formed around each of the first through holes 110. The second through hole 120 may not only transmit the third fluid discharged from the compressor, but also transmits the fluid of high temperature in the combustor assembly 1000. The third fluid may exchange heat with the high temperature fluid in the combustor assembly 1000 while passing through the second through hole 120 or may exchange heat while contacting the base portion 100. That is, the third fluid may cool down the base portion 1000 while passing through the second through hole 120 (see FIG. 5).

A diameter of the second through hole 120 may be smaller than that of the first through hole 110. Therefore, the second through hole 120 does not interfere with flow of the high temperature fluid in the combustor assembly 1000, and at the same time, the third fluid may cool down the base portion 100.

The insertion hole 130 is formed between the first through holes 110 and radially arranged based on the center of the base portion 100. The swirler 200 may be inserted to the insertion hole 130 to be fixed in the base portion 100. (see FIG. 6)

The first rib 140 and the second rib 150 may protrude from an outer portion of the base portion 100. The first rib 140 and the second rib 150 may be connected to the first liner 400 and the second liner 500.

The swirler 200 is inserted to the insertion hole 130 and supported by the base portion 100. The first fluid diverged by the compressor may pass through the swirler 200 to form a swirl flow. An opening is formed at a center of the swirler 200 so that the fuel injection portion 700 may be inserted therein. In FIGS. 1 and 2, eighteen swirlers 200 are shown, but the number of swirlers 200 in the combustor assembly 1000 is not limited thereto, and a user may change the number of swirlers 200 according to a size of the combustor assembly 1000 or an output amount. (see FIG. 6)

The swirler 200 forms an inlet of a dual structure so that the first fluid passing therethrough may have a greater swirling force. A first inlet 210 is formed inside the swirler 200 to form a central recirculation zone (CRZ) R in which the fluid in the combustor assembly 1000 circulates. A second inlet 220 is formed outside the first inlet 210 so as to evenly inject the fuel from the fuel injection portion 700 towards the internal space of the combustor assembly 1000.

The first liner 400 extends towards the first rib 140 so as to guide the flow of the high temperature and high pressure fluid in the combustor assembly 1000. The second liner 500 is formed around the second rib 150 of the base portion 100 so as to guide the flow of the high temperature and high pressure fluid in the combustor assembly 1000. The first liner 400 and the second liner 500 may form a flow path through which the high temperature and high pressure fluid that is ignited in the internal space of the combustor assembly 1000 may be moved towards a turbine.

The first liner 400 or the second liner 500 may include an anti-deformation portion 550 in order to prevent deformation generated due to thermal transfer from the fluid passing therethrough. When a diameter of the swirl flow formed by the swirler 200 increases, the fluid of high temperature and high pressure may apply excessive thermal shock to a surface of the first liner 400 or a surface of the second liner 500. The anti-deformation portion 550 may minimize generation of cracks generated due to concentration of stress in the surface of the first liner 400 or the surface of the second liner 500.

In more detail, the anti-deformation portion 550 may form a gap in the surface of the first liner 400 or the surface of the second liner 500 radially along with the moving direction of the fluid. The anti-deformation portion 550 induces expansion of the first liner 400 or the second liner 500 caused by the heat towards the gap so that the deformation of the first liner 400 or the second liner 500 may be minimized.

In addition, the anti-deformation portion 550 may be arranged as a plurality of pins on the surface of the first liner 400 or the second liner 500 in order to increase an area contacting the high temperature and high pressure fluid. When the area contacting the high temperature and high pressure fluid increases, a thermal transfer amount per unit area is reduced, and thus, deformation of the first liner 400 or the second liner 500 may be minimized. Hereinafter, a case where the anti-deformation portion 550 forms the gap in the surface of the first liner 400 or the second liner 500 will be described below for convenience of description.

The housing 600 is disposed to surround the first liner 400 and the second liner 500 so that the combustor assembly 1000 may be connected to a compressor (not shown) and a turbine (not shown). In detail, the inlet 610 of the housing 600 is connected to the compressor so that the compressed fluid may be introduced into the combustor assembly 1000. The outlet 620 of the housing 600 is connected to the turbine so as to discharge the high temperature and high pressure fluid that is combusted.

The fuel injection portion 700 is connected to a side of the housing 600 so as to penetrate therethrough, and may be inserted to the opening of the swirler 200. Fuel injected from the fuel injection portion 700 may be smashed and sprayed by the swirler 200. In addition, the combustor assembly 1000 includes the fuel injection portion 700 at the center of the swirler 200 so that the fuel may be injected to a center of the CRZ formed by the swirler 200 and combustion may be performed stably.

FIG. 4A is a perspective view of the deflector 300 of FIG. 1, and FIG. 4B is a perspective view of the deflector 300 according to another embodiment of the present invention.

Referring to FIG. 4A, the deflector 300 according to the embodiment of the present invention may be described as follows.

The deflector 300 changes a flow direction of the second fluid so as to cool down the combustor assembly 1000. As shown in FIGS. 1 and 2, the deflector 300 is formed in the base portion 100 so as to correspond to the first through hole 110. The deflector 300 may include a supporter 310, a direction switching portion 320, and a through hole portion 330.

The supporter 310 may couple the deflector 300 to the base portion 100 so that the deflector 300 may be supported by the base portion 100. The direction switching portion 320 may extend from the supporter 310. At least a part of the supporter 310 or the direction switching portion 320 may be curved so as to minimize resistance against the fluid passing through the deflector 300 and to effectively cool down the combustor assembly 1000.

The through hole portion 330 may penetrate through the supporter 310 or the direction switching portion 320. The number of the through hole portion 330 is not limited to a certain value, but may be set according to a size of the deflector 300, a flow amount of the second fluid introduced through the first through hole 110, or a target cooling amount that is to be cooled down by the deflector 300. A radius of the through hole portion 330 is smaller than that of the first through hole 110 so that the second fluid that has passed through the first through hole 110 may be dispersed to cool down the deflector 300.

A plurality of the through hole portions 330 may be arranged in the deflector 300 with constant intervals therebetween so as to increase a contact area between the second fluid and the deflector 300 and to increase a cooling amount of the deflector 300. The plurality of through hole portions 330 may be arranged in the deflector 300 with constant intervals therebetween so as to easily predict a flow direction of the second fluid.

Diameters of the through hole portions 330 may be configured to increase from the center of the deflector 300 towards the outer portion. The second fluid that has passed through the first through hole 110 firstly contacts the center of the deflector 300, and then, moves toward the outer side of the deflector 300. The second fluid exchanges heat with the deflector 300, and thus, the temperature of the second fluid gradually rises while the second fluid moves. Since the cooling amount at the outer side of the deflector 300 is less than that at the center of the deflector 300, uneven cooling may occur in the deflector 300. The uneven cooling of the deflector 300 may cause deformation of the deflector 300. When the diameters of the through hole portions 330 increase from the center towards the outer side of the deflector 300, a contact area between the deflector 300 and the second fluid at the outer side may increase. That is, the through hole portion 330 may maintain even cooling amount of the deflector 300 even when the second fluid moves to the outer side of the deflector 300, and thus, the deflector 300 may be evenly cooled down.

The deflector 300 may change a flow direction of the second fluid from a lengthwise direction of the combustor assembly 1000 to a radial direction of the combustor assembly 1000. The direction switching portion 320 and the supporter 310 form a path through which the second fluid may flow, and the second fluid may move between the direction switching portion 320 and the base portion 100. The path formed by the direction switching portion 320 and the supporter 310 is arranged radially towards the center of the base portion 100, the flow direction of the second fluid may be changed to the radial direction of the combustor assembly 1000.

Referring to FIG. 4B, a deflector 300*a* according to another embodiment of the present invention may be described as follows. The deflector 300*a* includes a supporter 310*a* and a direction switching portion 320*a*, which are similar to those of the deflector 300 according to the previous embodiment, and thus, descriptions thereof will be omitted.

A through hole portion 330*a* may penetrate through the supporter 310*a* or the direction switching portion 320*a*. The through hole portion 330*a* may be formed at an outer portion of the supporter 310*a* or the direction switching portion 320*a*.

In detail, the through hole portion 330*a* may be formed at an outer side of the portion corresponding to the first through hole 110. The flow direction of the second fluid that flows in an X-axis direction after passing through the first through hole 110 is changed by the direction switching portion 320*a*, and then, is moved in the radial direction of the combustor assembly 1000. Since there is no hole through which the second fluid may pass at the portion corresponding to the first through hole 110, most of the second fluid introduced through the first through hole 110 changes its flow direction to the radial direction of the combustor assembly 1000. When an amount of the second fluid passing in the radial direction of the combustor assembly 1000 increases, an amount of the second fluid contacting end portions of the supporter 310*a* and the direction switching portion 320*a* increases and a cooling amount at the end portion of the deflector 300*a* may increase. In addition, a moving distance of the second fluid increases, and accordingly, the cooling amount via the deflector 300*a* may increase.

FIG. 5 is a perspective view showing an enlarged view of the deflector 300 of FIG. 1, and FIG. 6 is a cross-sectional view taken along a line VI-VI of FIG. 2.

Referring to FIGS. 5 and 6, flow of the high temperature and high pressure fluid, a flow direction of the second fluid that has passed through the first through hole 110, and cooling down of the deflector 300 according to the flow of the second fluid in the combustor assembly 1000 will be described.

The first fluid discharged from the compressor passes through the swirler 200 to form a CRZ (R) in an internal space of the combustor assembly 1000. Fuel injected from the fuel injection portion 700 is sprayed by the first fluid that has passed through the swirler 200, introduced into the CRZ (R), and ignited by an ignition plug (not shown).

The second fluid discharged from the compressor may pass through the first through hole 110 while moving in a lengthwise direction (X-axis direction) of the combustor assembly. The second fluid collides with the direction switching portion 320 of the deflector 300, and then, a flow direction is changed from the X-axis direction to the radial direction of the combustor assembly 1000. After that, the second fluid moves in the radial direction of the combustor assembly 1000 along with the path formed by the supporter 310 and the direction switching portion 320 of the deflector 300, and some of the second fluid moves towards the internal space of the combustor assembly 1000 while passing through the through hole portion 330.

In detail, the second fluid forms a flow in direction A, a flow in direction B, and a flow in direction C. The second fluid passes through the first through hole 110 to form the flow in the direction A, and the flow in the direction A is changed to the flow in the direction B by the direction switching portion 320. The path formed by the supporter 310 and the direction switching portion 320 of the deflector 300 are arranged towards the center of the base portion 100. A part of the flow in the direction B moves towards the center of the base portion 100 (⊙), and another part of the flow in the direction B moves towards an outer portion of the base portion 100 (Ⓧ). While a part of the second fluid moves towards the center of the base portion 100 (⊙) and another part of the second fluid moves to the outer portion of the base portion 100 (Ⓧ), some of the flow in the direction B is branched to form the flow in the direction C.

A third fluid discharged from the compressor is moved to a space between the housing 600 and the first liner 400 or a space between the housing 600 and the second liner 500 of FIG. 3. In addition, the third fluid may exchange heat with the base portion 100 while passing through the second through hole 120 of the base portion 100. The third fluid may directly exchange heat with the high temperature and high pressure fluid in the internal space of the combustor assembly 1000.

In order to perform the combustion continuously and stably in the combustor assembly 1000, the CRZ (R) where the flames may be fixed has to be formed. The first fluid that has passed through the swirler 200 is swirled by wings of the swirler 200 so as to form the CRZ (R). The fuel injected from the fuel injection portion 700 may be injected to the CRZ (R) so as to be combusted continuously and stably.

A plurality of the swirlers 200 may respectively form CRZs (R), and the frames are maintained in each of the CRZs (R). Here, the CRZ (R) between two neighboring swirlers 200 may be reinforced with each other due to an aerodynamic interaction, and accordingly, a strong flame flow having an increased diameter may be formed. The strong flame flow is concentrated on the base portion 100 between the swirlers 200, and durability of the combustor assembly 1000 may degrade due to thermal shock.

The second fluid may exchange heat with the deflector 300 while contacting the deflector 300, or with the high temperature and high pressure fluid in the combustor assembly 1000. When the second fluid forms the flow in the direction A, the flow in the direction B, and the flow in the direction C, the temperature of the second fluid may rise. On the other hand, the temperature at the base portion 100 between the deflector 300 and the swirler 200 may decrease due to the heat exchange with the second fluid. The heat exchange with the second fluid passing through the deflector 300 may reduce the concentration of the heat or the thermal shock in the combustor assembly 1000, and accordingly, durability and stability of the combustor assembly 1000 may be maintained.

The first fluid is sprayed in the X-axis direction by the swirler 200, and after that, is circulated to form the CRZ (R). The second fluid forms a flow in the radial direction based on the X-axis due to the deflector 300 (flow in the direction B). The flow in the direction B of the second fluid and the flow in the X-axis direction of the first fluid are different from each other, and thus, the first fluid and the second fluid may move without generating the aerodynamic interference with each other. That is, the deflector 300 may effectively cool down the combustor assembly 1000 while maintaining the flame stability in the CRZ (R).

When the fuel is combusted, soot is generated in the combustor assembly 1000, and the soot may be accumulated on the surface of the base portion 100. Soot is generally black, and thus, absorbs radiation heat from the high temperature fluid in the combustor assembly 1000 and heats the base portion 100 more. The deflector 300 may remove the soot from the surface of the base portion 100 by using friction between flows while changing the flow direction.

When the second fluid moves along the flow in the direction B, the heat exchange amount may be reduced as the second fluid moves in the radial direction. The through hole portions 330 and **330*a* form the flow direction C so as to increase the contact area between the second fluid and the deflectors 300 and 300*a***, and thus, the heat exchange amount may be increased.

The base portion 100 may form the second through hole 120 adjacent to the first through hole 110. The third fluid and the fluid in the combustor assembly 1000 may pass through the second through hole 120. As shown in FIG. 6, the second through hole 120 forms the flow in a direction D, and the heat exchange between the second fluid and the fluid in the combustor assembly 1000 and heat exchange between the second fluid and the base portion 100 may be performed. The second through hole 120 has a diameter that is smaller than that of the first through hole 110 so that the flow in the direction D may cool down the base portion 100 while stably maintaining the CRZ.

The high temperature and high pressure fluid in the combustor assembly 1000 may deform the first liner 400 or the second liner 500 while contacting the first liner 400 or the second liner 500. The anti-deformation portion 550 formed at the first liner 400 or the second liner 500 may induce the thermal expansion to the gap so as to minimize the deformation of the combustor assembly 1000 (see FIG. 3).

While the detailed description has been particularly described with reference to non-obvious features of the present invention, it will be understood by one of ordinary skill in the art that various deletions, substitutions, and changes in form and details of the aforementioned apparatus and method may be made therein without departing from the spirit and scope of the following claims.

INDUSTRIAL APPLICABILITY

According to the embodiments of the present invention, a deflector is provided so as to effectively cool down a combustor assembly, and the embodiments of the present invention may be applied to all kinds of industrially used power generation systems, gas turbine systems, etc. including a compressor system.

The invention claimed is:

1. A combustor assembly comprising:

a plurality of swirlers through which a first fluid that is a part of a fluid discharged from a compressor passes;

an annular shaped base portion, in which the plurality of swirlers are provided, comprising a first through hole formed between one swirler and another swirler from among the plurality of swirlers so that a second fluid that is another part of the fluid discharged from the compressor and different from the first fluid passes through the first through hole; and a deflector provided in the annular shaped base portion between the one swirler and the another swirler so as to face the first through hole, the deflector changing a moving direction of the second fluid from the first through hole in a lengthwise direction of the combustor assembly to a radial direction both toward a center of the annular shaped base portion and away from the center of the annular shaped base portion, wherein the deflector comprises a pair of elongated opposing supporters attached to and supported by the annular shaped base portion and a direction switching portion extending from one of the pair of elongated opposing supporters to the other of the pair of elongated opposing supporters, wherein the pair of elongated opposing supporters are elongated in the radial direction of the annular shaped base portion and arranged next to each other in a circumferential direction of the annular shaped base portion so that two opposing openings are formed with one of the opposing openings facing the center of the annular shaped base portion and the other of the opposing openings facing away from the center of the annular shaped base portion, wherein each of the pair of elongated supporters extends from a radially inner edge of the direction switching portion to a radially outer edge of the direction switching portion, and the second fluid that has passed through the first through hole is moved between the direction switching portion and the annular shaped base portion, and the moving direction of the second fluid changes to the radial direction both toward the center of the annular shaped base portion and away from the center of the annular shaped base portion, and the second fluid moves in the radial direction along the pair of elongated opposing supporters.

2. The combustor assembly of claim 1, wherein the deflector comprises a third through hole formed in the direction switching portion, the third through hole being disposed outside of a contacting portion of the direction switching portion, wherein the contacting portion is a portion that the second fluid contacts on the direction switching portion in the lengthwise direction of the combustor assembly.

3. The combustor assembly of claim 1, wherein centers of the plurality of swirlers and a center of the first through hole are spaced apart a predetermined distance from the center of the annular shaped base portion.

4. The combustor assembly of claim 1, wherein the deflector is formed so as to be at least partially curved.

5. The combustor assembly of claim 1, wherein each of the plurality of swirlers has a dual structure of inlet.

6. The combustor assembly of claim 5, wherein the dual structure of inlet includes a first inlet formed inside the each of the plurality of swirlers to form a central recirculation zone and a second inlet formed outside the first inlet to evenly inject the first fluid from the compressor.

7. A combustor assembly comprising:

a plurality of swirlers through which a first fluid passes;

an annular shaped base portion in which the plurality of swirlers are provided, the annular shaped base portion comprising a first through hole formed between one swirler and another swirler from among the plurality of swirlers so that a second fluid passes through the first through hole; and a deflector provided in the annular shaped base portion between the one swirler and the another swirler, the deflector comprising a pair of elongated opposing supporters attached to and supported by the annular shaped base portion and a direction switching portion extending from one of the pair of elongated opposing supporters to the other of the pair of elongated opposing supporters, wherein the pair of elongated opposing supporters are elongated in a radial direction of the annular shaped base portion and arranged next to each other in a circumferential direction of the annular shaped base portion such that two opposing openings are formed with one of the opposing openings facing a center of the annular shaped base portion and the other of the opposing openings facing away from the center of the annular shaped base portion, wherein each of the pair of elongated supporters extends from a radially inner edge of the direction switching portion to a radially outer edge of the direction switching portion, wherein the second fluid that has passed through the first through hole is moved between the direction switching portion and the annular shaped base portion, and the moving direction of the second fluid changes to the radial direction both toward the center of the annular shaped base portion and away from the center of the annular shaped base portion, and the second fluid moves in the radial direction along the pair of elongated opposing supporters, wherein the pair of elongated opposing supporters and the direction switching portion form a single unitary structure, and wherein each of the pair of elongated opposing supporters is connected to a respective circumferential edge of the direction switching portion.

* * * * *